United States Patent [19]

Lonczak

[11] Patent Number: 5,056,679

[45] Date of Patent: Oct. 15, 1991

[54] REFUSE CONTAINER ASSEMBLY

[76] Inventor: John Lonczak, 430 W. 24th St., New York, N.Y. 10011

[21] Appl. No.: 373,530

[22] Filed: Jun. 30, 1989

[51] Int. Cl.[5] ..... B65D 3/04; B65D 25/16

[52] U.S. Cl. ..... 220/404; 141/316; 141/390; 220/908; 229/4.5; 248/97

[58] Field of Search ..... 220/403, 404, 908, 909, 220/910; 229/4.5, 48 R; 141/316, 390, 391; 248/99

[56] References Cited

U.S. PATENT DOCUMENTS

| | | | |
|---|---|---|---|
| 562,674 | 6/1896 | Spiegle, Jr. | 229/4.5 |
| 1,014,297 | 1/1912 | Gores | 229/48 R |
| 2,140,996 | 12/1938 | Heifetz | 229/4.5 |
| 2,201,779 | 5/1940 | Lathrop | 220/403 |
| 2,220,913 | 11/1940 | Ringler | 229/4.5 |
| 2,319,384 | 5/1943 | Callan | 220/404 |
| 2,388,288 | 11/1945 | Ringler et al. | 229/48 R |
| 2,736,454 | 2/1956 | McConnell | 220/909 |
| 2,821,761 | 2/1958 | Meyers | 224/48 R |
| 3,208,478 | 9/1965 | Baines | 229/4.5 |
| 3,658,233 | 4/1972 | Voytko | 220/908 |
| 3,747,830 | 7/1973 | Goldman | 229/4.5 |
| 3,815,778 | 6/1974 | Martin | 220/404 |
| 3,822,524 | 7/1974 | Jerpbak | 141/390 |
| 4,457,483 | 7/1984 | Gagne | 141/316 |
| 4,513,038 | 4/1985 | Anthony | 383/109 |
| 4,711,367 | 12/1987 | Albertson | 220/404 |

*Primary Examiner*—Stephen Marcus

*Attorney, Agent, or Firm*—Michael Ebert

[57] ABSTRACT

A refuse container assembly that includes an erectable, open-ended cylinder formed from a rectangular board of flexible, synthetic plastic material that is rollable into a cylindrical form and is provided with detachable locking means to maintain this form. Lining the cylinder and enclosing its bottom end is a collapsible plastic trash bag whose length is somewhat greater than that of the cylinder to define an upper margin that is folded over the rim of the cylinder to form a holding collar to maintain the bag in place. The outer surface of the cylinder is colored or otherwise adorned to blend the assembly in with the existing decor.

7 Claims, 1 Drawing Sheet

REFUSE CONTAINER ASSEMBLY

BACKGROUND OF INVENTION

1. Field of Invention

This invention relates generally to receptacles for refuse, and more particularly to a container assembly for this purpose constituted by an erectable, open-ended cylinder and a collapsible plastic trash bag lining the cylinder to create a refuse receptacle.

2. Status of Prior Art

The conventional garbage or trash can is fabricated of heavy duty metal or synthetic plastic material and is designed to withstand rough handling. Where the refuse to be collected in the can is in the form of food waste or other substances which tend to stick to or smear the inner surface of the garbage can, the common practice is to line the can with a collapsible plastic trash bag. The bag is of sufficient strength so that when filled, it may be tied and then removed from the can and discarded.

Plastic trash bags are available in supermarkets and other retail outlets in a range of standard sizes, each size being indicated in terms of the gallon capacity of the rigid container for which it is intended. Thus trash bags are available for relatively small household kitchen refuse receptacles as well as for larger outdoor garbage cans.

There are many special occasions when the aggregate capacity of the garbage cans that are available is altogether inadequate to meet the garbage collection demands imposed by the occasion. Thus at a catered wedding reception held, say, on a spacious lawn adjoining a residence to which many guests are invited, one can anticipate that the garbage collection requirements for this reception will exceed the collection capacity of whatever household garbage cans are available.

In order to meet these exceptional requirements, one may try to borrow garbage cans from neighbors, but this may present problems, especially if the neighbors have not been invited to the reception. Moreover, even if one succeeds in assembling a large number of borrowed garbage cans, it is then necessary before returning them to be sure they have not been battered and are in clean condition.

City street fairs to celebrate special events are now commonplace. While street garbage cans supplied by the municipality are available, usually these are grossly inadequate for a street fair. It is not uncommon, therefore, to find after the fair has run its course that the street is strewn with refuse.

Moreover, when a large number of assorted garbage cans are assembled for collecting refuse at a given event, and these cans are distributed at appropriate sites, the exposed cans may introduce a discordant note, for they are generally unsightly and may clash with the decor set up for the special occasion.

Garbage cans are strictly utilitarian in appearance and a can placed, say, next to a serving facility that has been adorned in a manner appropriate to a festive occasion, is clearly out of place. The lack of harmony in this respect is even worse should refuse receptacles be improvised out of empty cardboard cartons.

Collapsible plastic trash bags are typically packaged in the flat folded state in a dispenser-type cardboard box. These trash bags do not present a storage problem, for one may keep a large supply of boxed trash bags in a small storage space. Nor do these bags present a cost problem, for such bags, even those of high strength, are relatively inexpensive.

But conventional metal or plastic garbage cans are not foldable or collapsible and they occupy a substantial space. Should the need arise for a large number of such cans, this presents a problem in regard to where to store these cans prior to use. And it also presents a cost problem, for a typical garbage can, especially one of large capacity, is not inexpensive.

Hence when the need arises to collect large quantities of refuse in a situation where the available number of garbage cans falls far short of meeting this requirement, many disadvantages then attend the acquisition of additional cans for this purpose. The need for such cans is particularly acute at outdoor festivals, in parks or other public places where thousands of participants generate enormous quantities of trash. In a period when ecological pollution is of great public concern, there is a growing need for low-cost trash cans that can be quickly set up to meet special requirements.

And since in the era of recycling in which consumers are expected to collect and return empty bottles and cans, the need exists for a home receptacle especially adapted for this purpose.

SUMMARY OF INVENTION

In view of the foregoing, the main object of this invention is to provide a container assembly for collecting refuse, which assembly in the storage mode occupies relatively little space, even though the assembly in its refuse collection mode has a large capacity.

A significant advantage of a refuse container assembly in accordance with the invention is that it is adapted to blend in with an existing decor so that its appearance is not offensive in any way, and indeed may lend a festive note to the occasion.

Also an object of the invention is to provide a refuse container assembly which is inexpensive to make and which can be assembled without difficulty by the user.

Briefly stated, these objects are attained in a refuse container assembly that includes an erectable, open-ended cylinder formed from a rectangular board of thin, flexible, synthetic plastic material that is rollable into a cylindrical form and is provided with detachable locking means to maintain this form. Lining the cylinder and enclosing its bottom end is a collapsible plastic trash bag whose length is somewhat greater than that of the cylinder to define an upper margin that is folded over the rim of the cylinder to form a holding collar to maintain the bag in place. The outer surface of the cylinder is colored or otherwise adorned to blend the assembly in with the existing decor.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
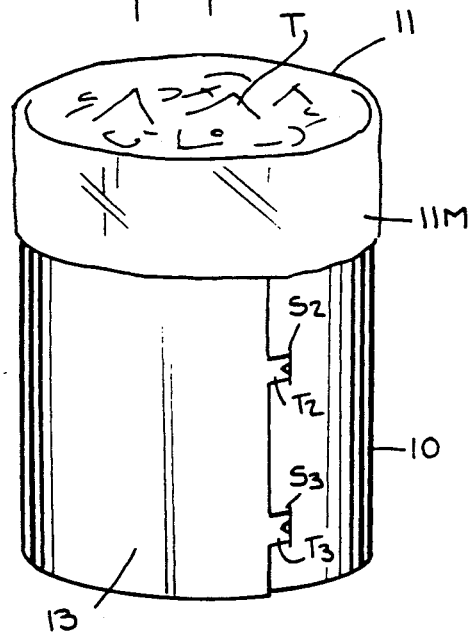
FIG. 1 is a perspective view of a refuse container assembly according to the invention in its refuse collection mode.
Figure 3:
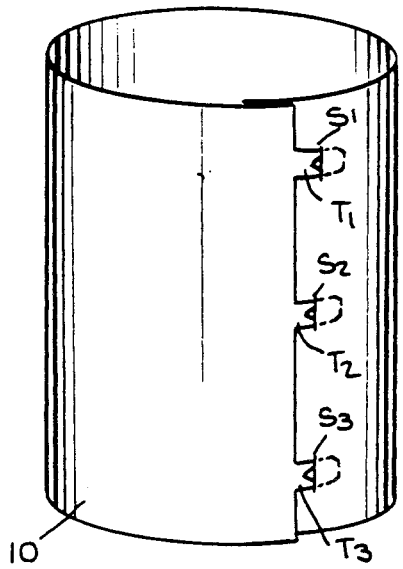
FIG. 3 is a separate view of the erected open-ended cylinder included in the assembly.
Figure 2:
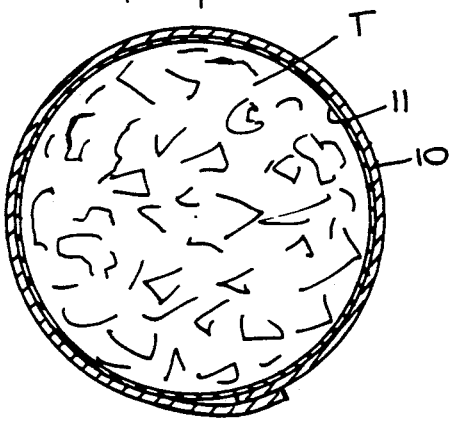
FIG. 2 is a transverse section taken through the assembly.

Referring now to FIG. 1, illustrated therein in its refuse collection mode is a refuse container assembly in accordance with the invention. The assembly is constituted by an erectable open-ended cylinder 10 which is lined by a trash bag 11 so that the open bottom of the cylinder is closed by the bottom of the bag.

The length of bag 11 is somewhat greater than that of cylinder 10, and its upper margin 11M is folded over the rim of the cylinder to form a holding collar which maintains the bag in place. Trash bag 11 is of the type commercially available in a range of different standard sizes which are related to the gallon capacity of the can for which the bag is intended. These bags are fabricated of synthetic plastic film material, such as polyvinyl chloride or polyester, and are preferably in multi-ply form, the strength of the bag depending on the number of plies and the material from which it is made. More or less filling the bag is a collection of trash T.

Cylinder 10 is provided in a range of standard sizes related to the available range of trash bag sizes. In this way, one may make available to the user small, medium, large and extra large refuse container assemblies. Thus in one embodiment of the invention, the cylinder has a length of 18 inches and a diameter of 13 inches.

Figure 4:
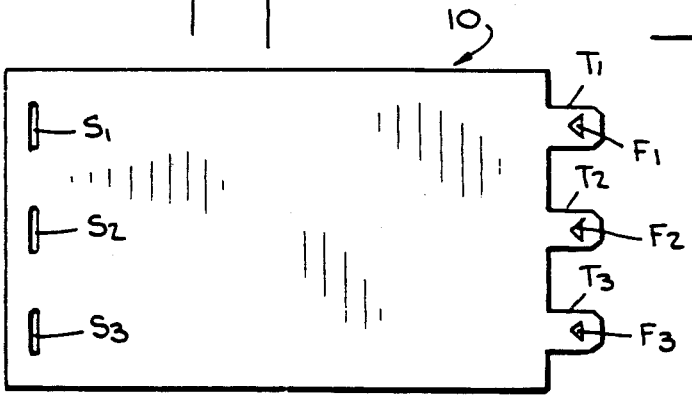
FIG. 4 shows the cylinder in its storage mode.

Cylinder 10 in its storage mode is constituted by a thin rectangular board of synthetic plastic material, as shown in FIG. 4, whose dimensions are appropriate to the desired dimensions of the cylinder. The cylinder is formed by rolling the board into a cylindrical form and locking the form to prevent unrolling. In practice, the board may be die-cut from commercially available polyvinyl chloride or other suitable plastic sheeting of acceptable strength.

To provide detachable locking means for the erectable cylinder, projected from one end of the board is a set of three die-cut tabs $T_1$, $T_2$ and $T_3$, each having a triangular cut-out flap $F_1$, $F_2$ and $F_3$. These tabs are insertable in correspondingly positioned slots $S_1$, $S_2$ and $S_3$ die-cut in the board adjacent the opposite end thereof.

Figure 5:
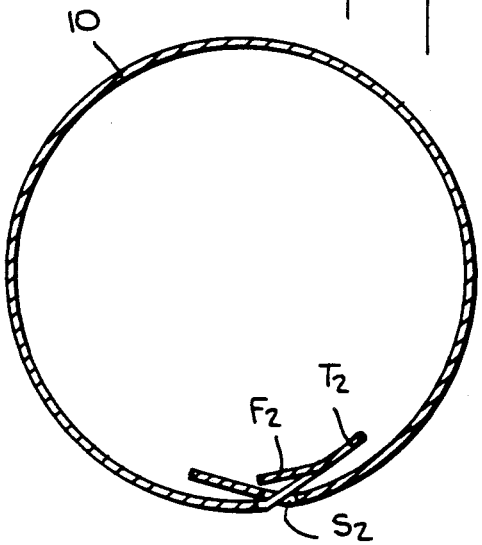
FIG. 5 is a transverse section taken through the erected cylinder showing how its detachable locking means operates.

When, as shown in FIG. 5, the board is rolled into a cylindrical form and a tab $T_2$ is then inserted into a slot $S_2$, the tab is prevented from being withdrawn by flap $F_2$, which, as the board seeks to unroll, bends out and is caught by the slot to prevent removal of the tab.

In the storage mode, trash bag 11 is in a folded, flat state (not shown), hence it occupies relatively little space. One may maintain a large supply of such trash bags, for they are commercially available in dispenser boxes, each housing a stack of folded trash bags. The cylinders in the storage mode are in the flat board state, a shown in FIG. 4; hence a large supply of such boards may be maintained in a relatively small storage space.

Figure 6:
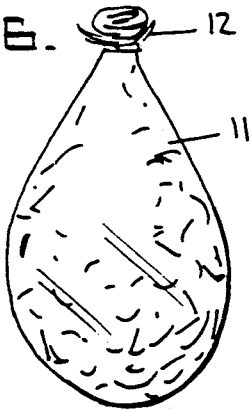
FIG. 6 shows the trash bag filled with refuse after it is tied and removed from the cylinder.

Trash bags are normally provided with ties 12, as shown in FIG. 6, so that when the bag in the refuse receptacle container assembly is filled with refuse, it may be tied and then removed from the cylinder and discarded.

In order to blend in the assembly with the existing decor of the environment in which the assembly is placed, cylinders 10 are formed of brightly colored plastic sheeting, cylinders being provided in a range of different colors. Thus, red cylinders may be appropriate for certain occasions while blue or orange cylinders may be called for in other situations. The cylinders may be printed in a decorative pattern 13, as shown in FIG. 1, or provided with graphics to render them more attractive.

Thus when the occasion arises, one may erect a large number of refuse container assemblies sufficient to meet the anticipated refuse collection demands, and in colors or decorative patterns in harmony with the environment in which these assemblies are to be placed.

When the need no longer exists for these assemblies, the trash bags are discarded and the cylinders are then unlocked and unrolled to their flat storage mode for subsequent use. In practice, the cylinders may be made in a black, white or a neutral color and adorned by stick-on decorative paper plaques.

A refuse container assembly in accordance with the invention may be used in the home to collect empty bottles and cans to be returned for recycling; for after having filled the bag with cans and bottles, it can be tied and removed from the cylinder and the bag carried back to a retail establishment or recycling station.

The assembly may also be used in an apartment to collect dirty laundry to be washed, say, in a basement washing machine or elsewhere outside of the apartment. In this instance, instead of a plastic trash bag, the bag used in conjunction with the cylinder would be a fabric laundry bag.

In practice, a lid may be provided for the assembly having a circular flange whose diameter is somewhat greater than that of the cylinder so that the flange will fit over the collar formed by the bag 11 whose margin 11M is folded over the rim of the cylinder.

While there has been shown and described a preferred embodiment of a refuse container assembly in accordance with the invention, it will be appreciated that many changes and modifications may be made therein without, however, departing from the essential spirit thereof.

Thus while the cylinder has been described as being made of a board of synthetic plastic material, in practice it may be made of flexible paper board or multiply paper stock capable of being rolled into a cylinder. And in practice, the cylinder may be provided with a circular base which can be press fit therein to convert the cylinder into a can.

I claim:

1. A container assembly comprising:

(a) an erectable, open-ended cylinder formed from a rectangular flat board of thin, flexible, synthetic plastic material that is rollable into a cylindrical form, said board being die cut to define detachable locking means to maintain this form which seeks to unroll; and (b) a collapsible plastic bag lining the cylinder and enclosing its bottom end, said bag having a length somewhat greater than that of the cylinder to define an upper margin that is folded over the rim of the cylinder to form a holding collar to maintain the bag in place, said locking means being constituted by a set of tabs projecting longitudinally from one end of the board and a corresponding set of transverse slots adjacent the opposite end of the board, each tab having a bendable cut-out flap which, when the tab is inserted in the corresponding slot, is caught in the slot as the cylinder seeks to unroll to prevent removal of the tab therefrom, said assembly having a storage mode in which said bag is in a collapsed state and said board is flat and free of protuberances, and a collection mode in which the board is rolled into a cylinder and is lined by the bag.

2. An assembly as set forth in claim 1, wherein each of said flaps is triangular.

3. An assembly as set forth in claim 1, wherein said board has an outer surface that is colored or decorated in a manner in harmony with the decor of the environment to which the assembly is intended.

4. An assembly a set forth in claim 1, wherein said bag is a plastic trash bag.

5. An assembly as set forth in claim 1, wherein said bag is of multi-ply construction.

6. An assembly as set forth in claim 1, in which the board is formed of polyvinyl chloride.

7. An assembly as set forth in claim 1, wherein said bag is a laundry bag.

* * * * *